US009932835B2

(12) United States Patent
Slavens et al.

(10) Patent No.: US 9,932,835 B2
(45) Date of Patent: Apr. 3, 2018

(54) AIRFOIL COOLING DEVICE AND METHOD OF MANUFACTURE

(71) Applicant: United Technologies Corporation, Hartford, CT (US)

(72) Inventors: Thomas N. Slavens, Vernon, CT (US); Thomas J. Martin, East Hampton, CT (US); Brooks E. Snyder, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 311 days.

(21) Appl. No.: 14/698,269

(22) Filed: Apr. 28, 2015

(65) Prior Publication Data

US 2015/0337667 A1 Nov. 26, 2015

Related U.S. Application Data

(60) Provisional application No. 62/002,441, filed on May 23, 2014.

(51) Int. Cl.
*F01D 5/18* (2006.01)

(52) U.S. Cl.
CPC ..... *F01D 5/18* (2013.01); *F01D 5/187* (2013.01); *F05D 2220/30* (2013.01); (Continued)

(58) Field of Classification Search
None
See application file for complete search history.

(56) References Cited

U.S. PATENT DOCUMENTS 2,843,354 A * 7/1958 Smith ..... F01D 5/188 416/92
2,864,405 A * 12/1958 Young ..... F01P 11/08 138/38

(Continued)

FOREIGN PATENT DOCUMENTS

DE 853534 C 10/1952
DE 3306894 A1 8/1984

OTHER PUBLICATIONS

European Patent Office, the Extended European Search Report, dated Oct. 2, 2015, 8 pages.

*Primary Examiner* — Woody Lee, Jr.
*Assistant Examiner* — Theodore Ribadeneyra
(74) *Attorney, Agent, or Firm* — Kinney & Lange, P. A.

(57) ABSTRACT

An airfoil has an airfoil structure that defines a cooling passage for directing a cooling medium through the airfoil structure. A swirl structure is operatively associated with the cooling passage and configured to impart a tangential velocity to the cooling medium flowing through the cooling passage. An airfoil has an airfoil structure that defines a first cooling passage and a second cooling passage for directing cooling medium through the airfoil structure, each cooling passage having a swirl structure that imparts tangential velocity on the cooling medium flowing through the associated cooling passage. A method of making an airfoil that includes forming an airfoil structure that defines a cooling passage for directing a cooling medium through the airfoil structure and forming a swirl structure that is operatively associated with the cooling passage and imparts tangential velocity to the cooling medium flowing through the cooling passage.

18 Claims, 7 Drawing Sheets

(52) U.S. Cl.
CPC ..... *F05D 2230/21* (2013.01); *F05D 2230/22* (2013.01); *F05D 2250/25* (2013.01); *F05D 2260/20* (2013.01); *F05D 2260/201* (2013.01); *F05D 2260/2212* (2013.01)

(56) References Cited

U.S. PATENT DOCUMENTS

| | | | | | |
|---|---|---|---|---|---|
| 3,271,812 | A * | 9/1966 | Skolnik | E05D 13/1253 | 16/197 |
| 4,627,480 | A * | 12/1986 | Lee | B22C 9/04 | 164/122.1 |
| 5,002,460 | A * | 3/1991 | Lee | F01D 5/188 | 415/115 |
| 5,203,436 | A * | 4/1993 | Wieting | B60J 5/0447 | 296/146.6 |
| 5,704,763 | A * | 1/1998 | Lee | F01D 5/188 | 415/115 |
| 7,824,156 | B2 * | 11/2010 | Dellmann | F01D 5/187 | 416/96 R |
| 7,866,950 | B1 | 1/2011 | Wilson, Jr. | | |
| 8,047,789 | B1 | 11/2011 | Liang | | |
| 8,057,183 | B1 | 11/2011 | Liang | | |
| 8,066,483 | B1 | 11/2011 | Liang | | |
| 8,096,766 | B1 | 1/2012 | Downs | | |
| 8,109,726 | B2 | 2/2012 | Liang | | |
| 8,162,609 | B1 | 4/2012 | Liang | | |
| 8,322,988 | B1 | 12/2012 | Downs et al. | | |
| 2010/0003619 | A1 | 1/2010 | Das et al. | | |
| 2011/0048664 | A1 * | 3/2011 | Kush | B28B 1/001 | 164/6 |
| 2012/0076665 | A1 * | 3/2012 | Janke | F01D 5/187 | 416/97 R |
| 2014/0079539 | A1 | 3/2014 | Lehmann et al. | | |

* cited by examiner

AIRFOIL COOLING DEVICE AND METHOD OF MANUFACTURE

CROSS-REFERENCE TO RELATED APPLICATION(S)

This application claims the benefit of U.S. Provisional Application No. 62/002,441, filed May 23, 2014.

BACKGROUND

The present invention relates generally to gas turbine engines, and more particularly, to impingement cooling passages used in gas turbine engines.

A gas turbine engine commonly includes a fan, a compressor, a combustor, a turbine, and an exhaust nozzle. During engine operation, working medium gases, for example air, are drawn into the engine and compressed by the compressor. The compressed air is channeled to the combustor where fuel is added to the air and the air-fuel mixture ignited. The products of combustion are discharged to the turbine section, which extracts a portion of the energy from the combustion products to power the fan and the compressor.

The compressor and turbine often include alternating sections of rotating blades and stationary vanes. The operating temperatures of some engine stages, such as in the high pressure turbine rotor and stator stages, may exceed the material limits of the airfoils and therefore necessitate cooling of the airfoils. Cooled airfoils may include cooling channels, sometimes referred to as passages through which a coolant, such as compressor bleed air, is directed to convectively cool the airfoil. Airfoil cooling channels may be oriented spanwise from the base to the tip of the airfoil or axially between leading and trailing edges. The channels may be fed by one or more supply channels toward the airfoil base, where the coolant flows radially into the cooling channels. In some configurations, the cooling channels include small cooling passages, referred to as impingent cooling passages, which connect the cooling channel with an adjacent cavity or channel. The impingement cooling passages are sized and placed to direct jets of coolant on to interior airfoil surfaces such as the interior surfaces of the leading and trailing edges.

Prior airfoil designs have continually sought to decrease airfoil temperatures through cooling. A particular challenge in prior impingement cooled airfoil designs is with respect to a region affected by the thermal boundary layer. The thermal boundary layer of an impinging coolant jet is the flow region near the interior surface of the airfoil distorted by the effects of the coolant interacting with the surface. Because the thermal boundary layer distortion redirects a portion of the impinging coolant jet away from the interior airfoil surfaces, the cooling efficiency of the impingement jet decreases. However, due to the relatively high temperatures encountered during operation, a need still exists to improve impingement cooling of turbine blade and vane airfoils.

SUMMARY

An airfoil has an airfoil structure that defines a cooling passage for directing a cooling medium through the airfoil structure. A swirl structure is operatively associated with the cooling passage and configured to impart a tangential velocity to the cooling medium.

An airfoil has an airfoil structure that defines a first cooling passage and a second cooling passage for directing cooling medium through the airfoil structure. A first swirl structure is operatively associated with the first cooling passage, and a second swirl structure is operatively associated with the second cooling passage. Each swirl structure imparts tangential velocity to the cooling medium that can flow through the associated cooling passage. The first and second cooling passages have a hydraulic diameter and a centerline. The span between first and second passages is measured between centerlines. The ratio of the span divided by the hydraulic diameter is between 1.5 and 8.

A method of making an airfoil that includes forming an airfoil structure that defines a cooling passage for directing a cooling medium through the airfoil structure. The method also includes forming a swirl structure that is operatively associated with the cooling passage and is configured to impart tangential velocity to the cooling medium.

DETAILED DESCRIPTION

Figure 1:
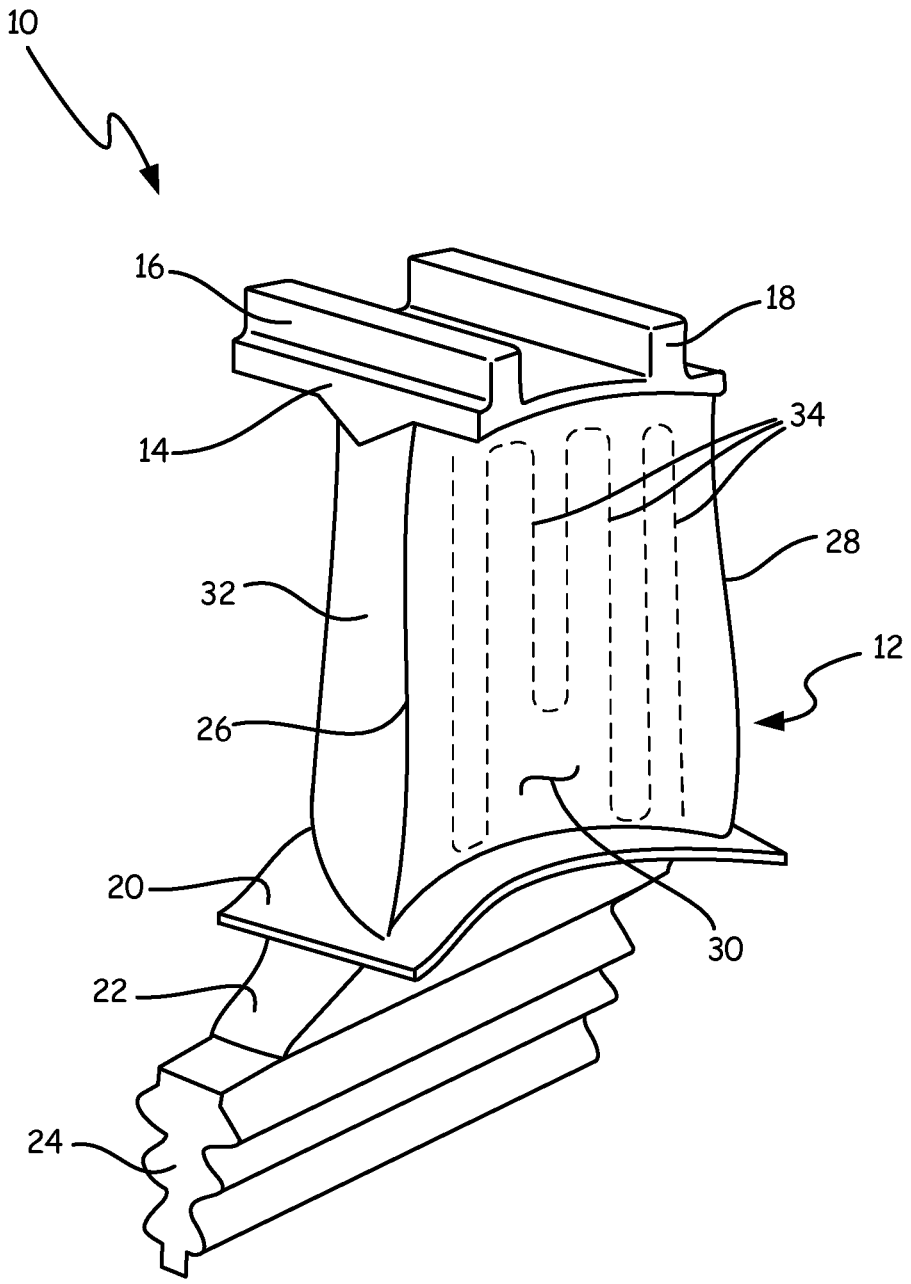
FIG. 1 is a perspective view of an internally cooled airfoil.

FIG. 1 is a perspective view of rotating turbine blade 10. Turbine blade 10 includes airfoil 12, outer diameter shroud 14, upstream sealing rail 16, downstream sealing rail 18, platform 20, shank 22, and fir tree 24. Turbine blade 10 is one example of a blade in an assembly of multiple turbine blades arranged in a rotor. Airfoil 12 is shaped to efficiently interact with a working medium gas, for example air, in a gas turbine engine. Outer diameter shroud 14 and platform 20 work together with adjacent blade shrouds and platforms to form an annular boundary for the working medium gas. Upstream and downstream sealing rails 16 and 18 are in close proximity with the turbine housing (not shown) to reduce the leakage of working medium gas near the outer diameter of turbine blade 10. Alternatively, outer diameter shroud 14 may be configured with an abradable surface that wears away to form a closely tolerance gap, forming an outer diameter seal. Shank 22 and fir tree 24 connect turbine blade 10 to a rotor disk (not shown) to form the turbine blade assembly. Alternatively, turbine blade 10 could be configured with another means of connection to the rotor disk (not shown) such as a dovetail or other mechanical means.

Airfoil 12 extends from platform 20 to outer diameter shroud 14 and includes leading edge 26, trailing edge 28, concave pressure wall 30, convex suction wall 32, and internal cooling channel 34. Concave pressure wall 30 and convex suction wall 32 extend from platform 20 to outer diameter shroud 14 and are joined at leading edge 26 and trailing edge 28. Working medium gas and combustion products exiting the combustor are guided through the turbine stage by leading edge 26, concave pressure wall 30 and convex suction wall 32, and exit the turbine stage downstream of trailing edge 28.

Increasing the temperature of the working medium gas improves the power output of the gas turbine engine. As such, the working medium gas temperature often exceeds limits for materials used in sections downstream of the combustor such as the turbine section. To overcome high temperatures from the working medium gas, downstream components are internally cooled to reduce the component temperature. In this particular embodiment, turbine blade 10 has internal cooling channel 34. Cooling channel 34 is supplied with a cooling medium, for example air bled from the compressor section of the gas turbine engine. The cooling medium enters cooling channel 34 through supply passages (not shown) that traverse fir tree 24, shank 22, and platform 20.

Figure 2:
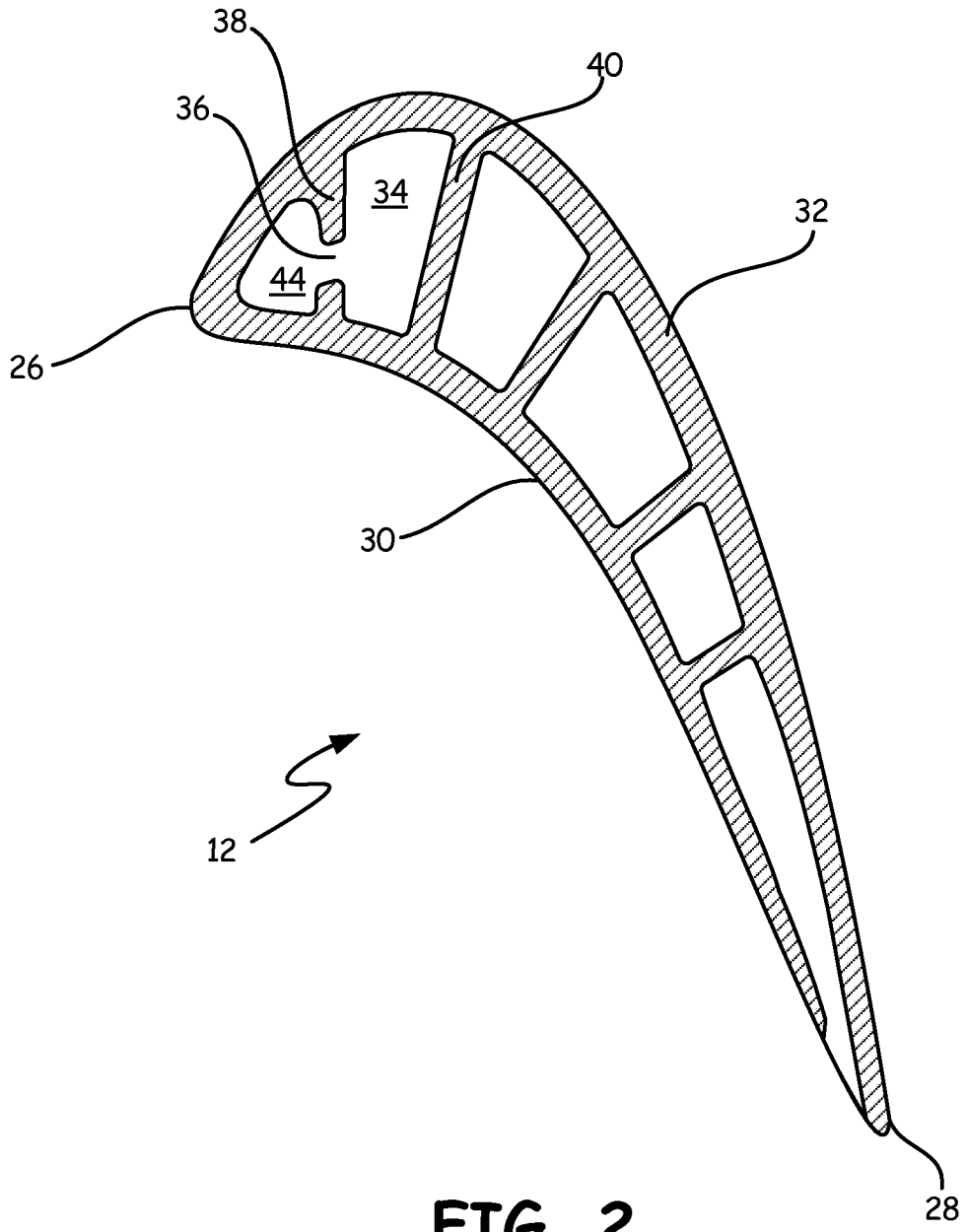
FIG. 2 is a cross-sectional view of the internally cooled airfoil of FIG. 1.

FIG. 2 is a cross-section of airfoil 12 that illustrates cooling channel 34 in greater detail. Cooling channel 34 is bounded by first rib 38, second rib 40, a portion of concave pressure wall 30, and a portion of convex suction wall 32. Generally, cooling channel 34 transports cooling medium radially from platform 20 (FIG. 1) to outer diameter shroud 14 (FIG. 1). Other variations of cooling channel 34 are possible such as an axial cooling channel, trailing edge cooling channel, or a serpentine cooling channel. In this particular embodiment, cooling channel 34 has a generally rectangular cross-section. In other embodiments, cooling channel 34 may be triangular, trapezoidal, circular, or other cross-section.

Cooling channel 34 communicates cooling medium with cooling passage 36. Cooling passage 36 directs the cooling medium into impingement cavity 44 and cools the interior surfaces of leading edge 26. Cooling passage 36 is formed within first rib 38 and can have a circular, rectangular, oval, or other cross-section. The cross-section of cooling passage 36 has a cross-sectional area that is smaller than the cross-sectional area of cooling channel 34 and is sized to produce a jet of cooling medium at the outlet of cooling passage 36. Cooling passage 36 includes swirl structure 42 (FIG. 3) that imparts tangential velocity to the cooling medium that flows through cooling passage 36. In this embodiment and other embodiments of the present invention, the structure imparts tangential velocity by deflecting the cooling medium that flows through the cooling passage in a tangential direction with respect to a centerline axis of the cooling passage. Fluid motion of this type is sometimes called swirl.

Figure 3:
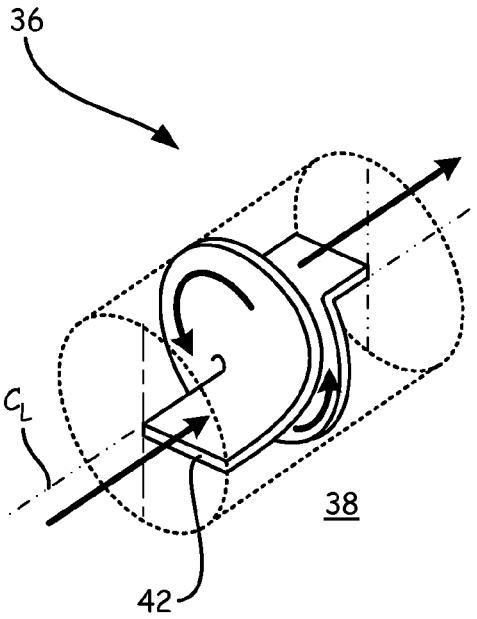
FIG. 3 is a perspective view of a cylindrical impingement cooling passage that has a structure defined by a single, half-diameter protrusion.

FIG. 3 is a perspective view of cylindrical cooling passage 36 showing structure 42 located at least partially or fully within cooling passage 36. Structure 42 extends from the interior surface of first rib 38 that defines cooling passage 36. Structure 42 has a shape that imparts tangential velocity to the cooling medium that travels through cooling passage 36. The cooling medium jet exits cooling passage 36 and impinges on the interior surface of leading edge 26 (FIG. 2) as a swirling impingement jet. In the particular embodiment shown in FIG. 3, structure 42 is a single protrusion that extends between the interior surface of first rib 38 to roughly the centerline of cooling passage 36 and takes the shape of a spiral ramp. Structure 42 has a half twist about the centerline of cooling passage 36.

Figure 4:
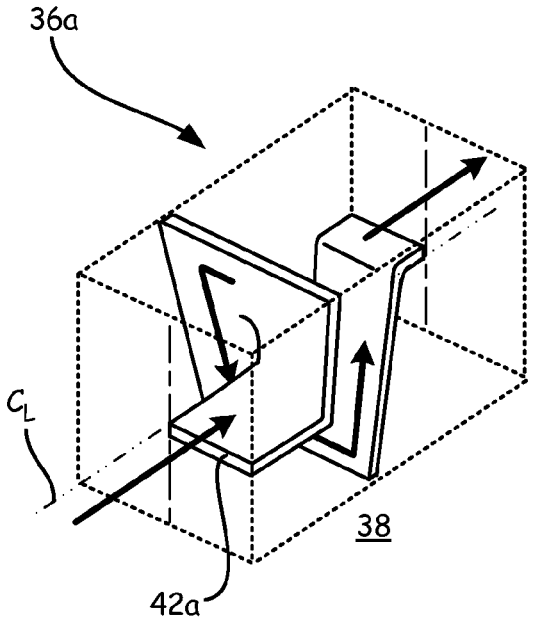
FIG. 4 is a perspective view of a rectangular impingement cooling passage that has a structure defined by a single, half-width protrusion.

FIG. 4 is a perspective view of rectangular cooling passage 36A showing structure 42A. Similar to the cylindrical cooling passage 36 of FIG. 3, structure 42A extends from the interior surfaces of first rib 38 and takes the form of a single protrusion having a generally spiral-like shape.

Figure 5A:
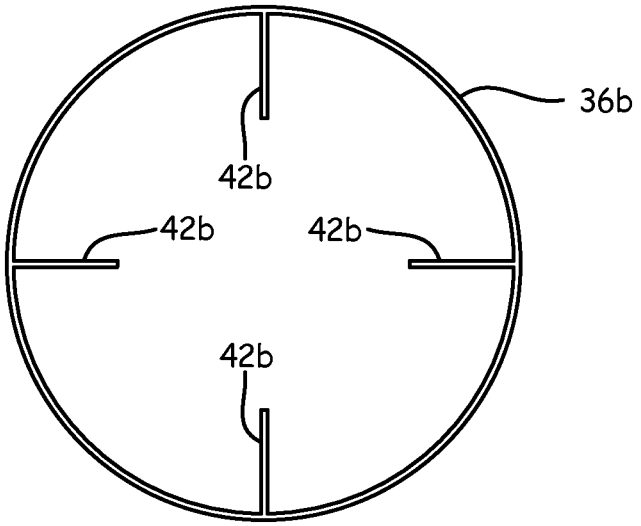
FIG. 5A is a cross-sectional view of a round impingement cooling passage that has alternative protrusion geometry.
Figure 5B:
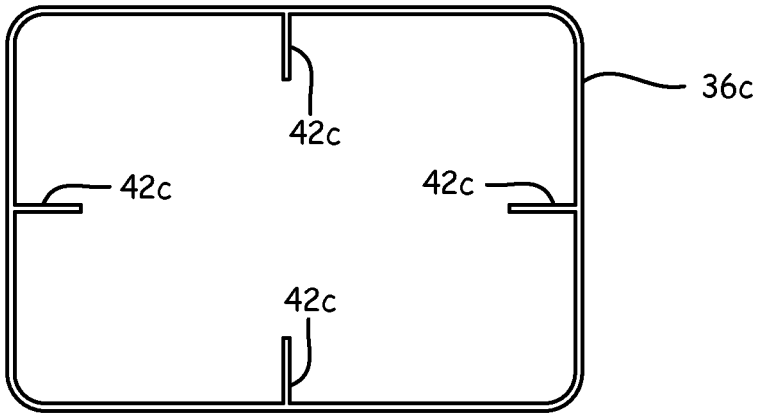
FIG. 5B is a cross-sectional view of a rectangular impingement cooling passage that has alternative protrusion geometry.

FIGS. 5A and 5B illustrate several protrusion configurations of structure 42. Structure 42*b* has four protrusions, each protrusion taking the general shape of a spiral ramp along the length of cylindrical cooling passage 36*b*. Structure 42*c* has four protrusions, each taking a spiral-like shape along the length of rectangular cooling passage 36*c*.

Figure 6A:
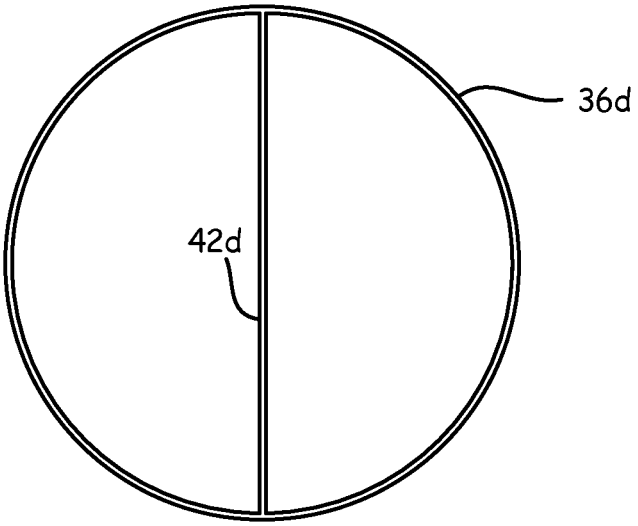
FIG. 6A is a cross-sectional view of a round impingement cooling passage that has alternative partition geometry.
Figure 6B:
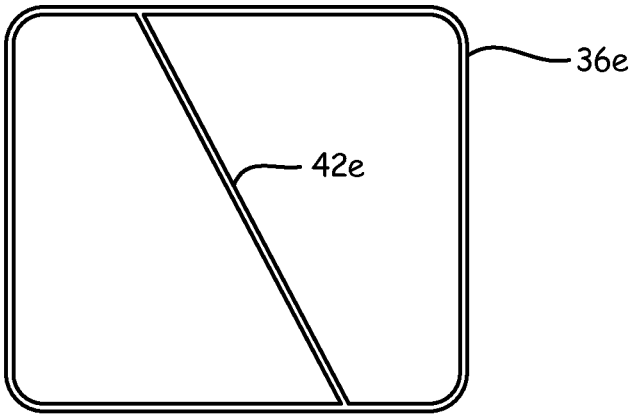
FIG. 6B is a cross-sectional view of a rectangular impingement cooling passage that has alternative partition geometry.

Structure 42 can also be a partition as illustrated in FIGS. 6A and 6B. Structure 42*d* has a single partition taking the general shape of a helicoid along the length of cooling passage 36*d*. Similarly, structure 42*e* has a single partition taking the general spiral-like shape along the length of rectangular cooling passage 36*e*.

Although the FIGS. 3-5 illustrate configurations of structures 42, 42*a*, 42*b*, and 42*c* with one or four protrusions and FIGS. 6A-6B illustrate a single partition, other numbers of protrusions or partitions are possible. For example, structure 42 may have two, three, or more protrusions or partitions. In addition, structure 42 may have more or less twists, the number being determined by the magnitude of tangential velocity required to achieve the desired airfoil cooling. In some embodiments, structure 42 has between one-quarter twist and four twists.

It will be appreciated that adding tangential velocity to the cooling medium that exits cooling passage 36 improves the cooling of the interior surfaces of leading edge 26. In general, impingement jets form thermal boundary layers surrounding the location impacted by the impingement jet. The thermal boundary layer is a region within the cooling medium in which the interaction between the cooled surface and the cooling medium locally decreases the cooling medium velocity relative to the impingement jet velocity. The thermal boundary layer acts to partially deflect cooler, more energetic cooling medium away from the cooled surface and to decrease the cooling of the surface locally. Providing the cooling medium with a tangential velocity between 10% and 80% of the absolute velocity of the impingement jet by flowing the cooling medium past structure 42 within cooling passage 36 will make the thermal boundary layer surrounding the impingement location thinner than it would be without adding the tangential velocity. It will be appreciated that reducing the thickness of the thermal boundary layer improves cooling of the interior surface of leading edge 26.

Figure 7:
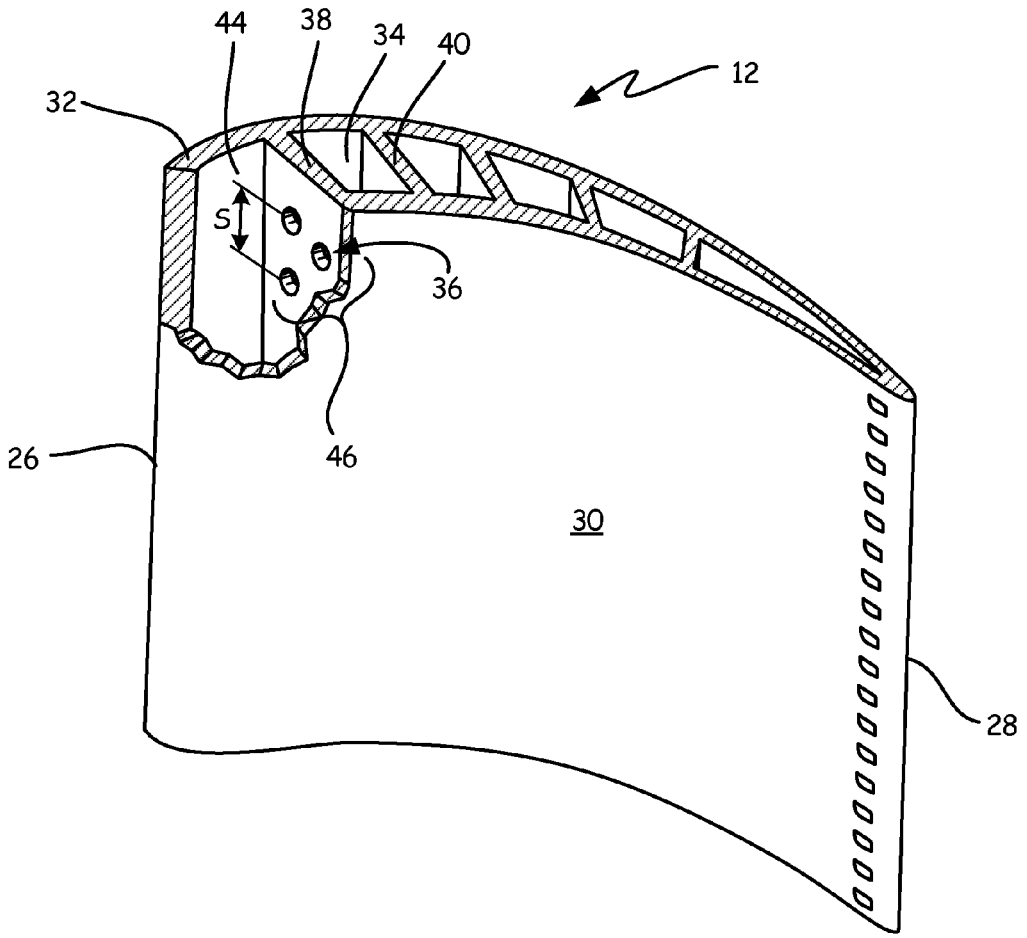
FIG. 7 is a perspective view of an airfoil section that shows multiple impingement cooling passages.

FIG. 7 is a perspective view of an internally cooled airfoil in which cooling passage array 46, comprised of multiple cooling passages 36, is useful to achieve the desired cooling. In such case, the ratio R is equal to the centerline-to-centerline cooling passage spacing S divided by hydraulic diameter D of cooling passage 36 and is useful for determining the cooling improvement of cooling passage array 46 equipped with structure 42. The hydraulic diameter of cooling passage 36 is equal to four times the cross-sectional area of cooling passage 36 divided by the cross-sectional perimeter of cooling passage 36.

Figure 8:
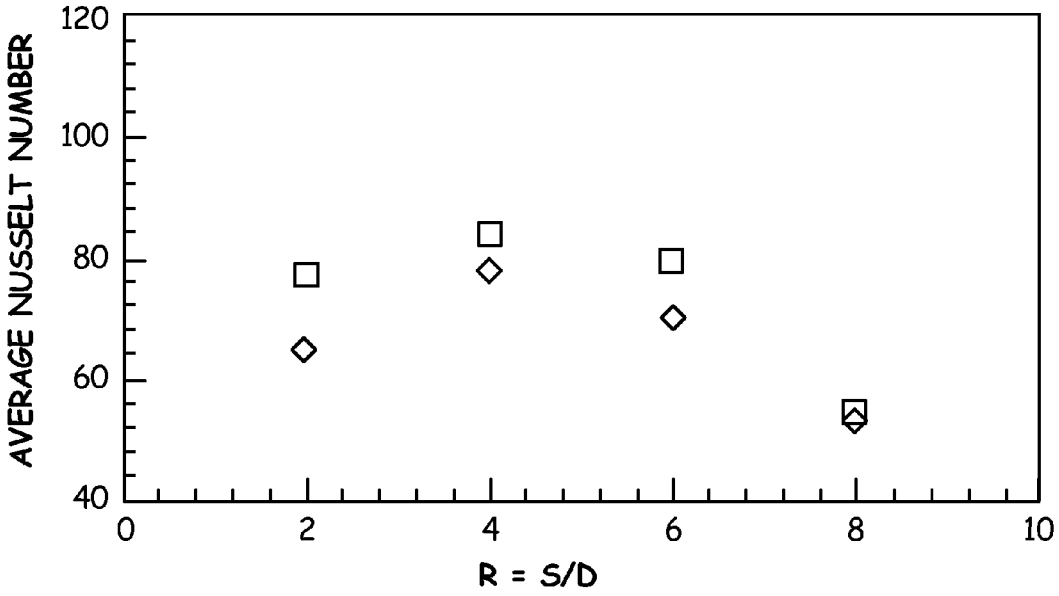
FIG. 8 is a graph showing the relative heat transfer performance of an impingement cooling passage equipped with a structure in accordance with the present disclosure.

FIG. 8 shows the relative benefit of additional cooling passages 46 when compared to the same cooling configuration without structure 42. Along the abscissa, the ratio R increases from 0 to 10. Along the ordinate axis, the average Nusselt number of a cooling passage array 46 increases from 40 to 120 where the average Nusselt number is the dimensionless heat transfer coefficient associated with the impingement jets exiting cooling passage array 46. The square data points represent the average Nusselt number of cooling passage array 46 of a given ratio R where each cooling passage in cooling passage array 46 have structure 42. The diamond data points represent the average Nusselt number of cooling passage array 46 of a given ratio R where the cooling passages do not have structure 42. The average Nusselt number associated of cooling passage array 46 with structure 42 is maximized when the ratio R is approximately two.

Other configurations of cooling passage 36 are possible, for example cooling passage 36 may direct cooling medium on to the interior surfaces of concave pressure wall 30, convex suction wall 32, or trailing edge 28. Structure 42 may have a twisting section that imparts tangential velocity and a straight section that does not impart tangential velocity where the twisting section is located downstream of the straight section.

Although the preceding embodiment describes the invention in the context of a shrouded turbine blade, the invention is equally applicable to other components in which impingement cooling is beneficial, for example, unshrouded turbine blades or turbine vanes. In the latter case, stationary turbine vanes are arranged between successive turbine blade stages and are used to redirect and guide the working medium gas into the next turbine stage. Each turbine vane stage is subjected to similar working medium gas temperatures and benefit from improved impingement cooling on the interior of the airfoil.

The manufacture of turbine blade 10 is enabled through the implementation of additive manufacturing techniques that allow formation of interlocked casting features. Typically, additive manufacturing creates turbine blade 10 through sequential layering of blade material. First, a three-dimensional model of airfoil 12, including ribs 38 and 40, cooling channels 34 and cooling passages 36 is created. Airfoil 12 is then additively manufactured layer-by-layer according to the model. Examples of additive manufacturing methods suitable for forming airfoil 12 include powder deposition coupled with direct metal laser sintering (DMLS) and electron beam melting (EBM). These additive manufacturing techniques allow the construction of airfoil 12 including the fine details present in cooling passage 36 such as structure 42.

Further, traditional casting methods utilizing additively created cores could be utilized to create the ceramic interior definition of cooling passage 36 with structure 42. This method of manufacture includes investment casting using a sacrificial core that defines cooling passage 36, including structure 42 using an additively built core or disposable core-die tooling. A cooling passage core is made from a ceramic or refractory metal material by casting or additive manufacturing. Cores for defining cooling channel 34 are similarly formed. All of the cores are arranged in a mold. The body of airfoil 12 is formed around the cores for the cooling channels and cooling passages. Once airfoil 12 is formed, the cores for the cooling channels and cooling passages are chemically removed to form cooling channels 34 and cooling passage 36 with structure 42.

Discussion of Possible Embodiments

The following are non-exclusive descriptions of possible embodiments of the present invention.

An airfoil can include an airfoil structure that defines a cooling passage for directing cooling medium within the airfoil structure and a swirl structure that is operatively associated with the cooling passage. The swirl structure can be configured to impart tangential velocity to the cooling medium.

A further embodiment of the foregoing airfoil can optionally include, additionally and/or alternatively, any one or more of the following features, configurations, and/or additional components:

A further embodiment of the foregoing airfoil can include a swirl structure that is at least partially within the cooling passage.

A further embodiment of any of the foregoing airfoils can include a swirl structure that is completely within the cooling passage.

A further embodiment of any of the foregoing airfoils can include a swirl structure protrusion that extends from at least one surface of the cooling passage.

A further embodiment of any of the foregoing airfoils can include a swirl structure partition that extends from at least one surface of the cooling passage. The cooling passage partition can divide the cooling passage volume into a plurality of volumes through which the cooling medium can flow.

A further embodiment of any of the foregoing airfoils can include a swirl structure that has between a quarter twist and fours twists about an axis extending between an inlet and an outlet of the cooling passage.

A further embodiment of any of the foregoing airfoils can include a swirl structure that has a straight portion and a twisting portion, the straight portion located upstream of the twisting portion.

A further embodiment of any of the foregoing airfoils can include a swirl structure configured to direct cooling medium on to an interior surface of a leading edge of the airfoil.

A further embodiment of any of the foregoing airfoils can include a swirl structure that imparts tangential velocity to the cooling medium that is 10% to 80% of an absolute velocity of the cooling medium flowing through the cooling passage.

A further embodiment of any of the foregoing airfoils can include a swirl structure that is generally a spiral ramp.

A further embodiment of any of the foregoing airfoils can include a swirl structure that is generally a helicoid.

An airfoil can include an airfoil structure that defines a first cooling passage and a second cooling passage. A first swirl structure can be operatively associated with the first cooling passage, and a second swirl structure can be operatively associated with the second cooling passage. Each swirl structure can impart tangential velocity to the cooling medium that can flow through the associated cooling passage. The first and second cooling passage can have a hydraulic diameter and a centerline. The span between the first and second cooling passages can be measured between cooling passage centerlines. The ratio of the span divided by the hydraulic diameter of the cooling passages can be between 1.5 and 8.

A method of cooling an airfoil can include forming an airfoil structure that defines a cooling passage for directing cooling medium through the airfoil structure and forming a swirl structure that is operatively associated with the cooling passage. The method can further include configuring the swirl structure to impart tangential velocity to the cooling medium.

A further embodiment of the foregoing method can optionally include, additionally and/or alternatively, any one or more of the following features, configurations, and/or additional components:

The further embodiment of the foregoing method can include forming a swirl structure that is at least partially within the cooling passage.

The further embodiment of any of the foregoing methods can include forming a swirl structure that is completely with the cooling passage.

The further embodiment of any of the foregoing methods can include forming a swirl structure protrusion that extends from at least one surface of the cooling passage.

The further embodiment of any of the foregoing methods can include forming a swirl structure partition that extends from at least one surface of the cooling passage. The swirl structure partition can divide the cooling passage into a plurality of volumes through which cooling medium can flow.

The further embodiment of any of the foregoing methods can include forming a swirl structure with between a quarter twist and four twists about an axis extending from an inlet to an outlet of the cooling passage.

The further embodiment of any of the foregoing methods can include forming a swirl structure that imparts tangential velocity to the cooling medium that can be between 10% and 80% of an absolute velocity of the cooling medium flowing through the cooling passage.

The further embodiment of any of the foregoing methods can include creating a three-dimensional computer model of a casting core for an airfoil that includes an airfoil structure and a swirl structure. The airfoil structure can define a cooling passage for directed cooling medium through the airfoil structure. The swirl structure can be operatively associated with the cooling passage and be configured to impart to the cooling medium tangential velocity. The method may further include forming a casting core in progressive layers by selectively curing a ceramic-loaded resin with ultraviolet light. The method may further include processing the casting core thermally such that the casting core is suitable for casting.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. An airfoil, comprising:

a concave pressure wall;

a convex suction wall;

a cooling channel extending between the concave pressure wall and the convex suction wall;

a cavity, wherein at least a portion of the cavity is bounded by at least one of the concave pressure wall and the convex suction wall;

an airfoil structure forming at least a portion of a boundary between the cooling channel and the cavity and defining a cooling passage extending therethrough, wherein the cooling passage is configured to direct a cooling medium from the cooling channel onto a surface of the cavity; and a swirl structure operatively associated with the cooling passage and configured to impart tangential velocity to the cooling medium, wherein the swirl structure is at least partially within the cooling passage.

2. The airfoil of claim 1, wherein the swirl structure is completely within the cooling passage.

3. The airfoil of claim 1, wherein the swirl structure comprises a protrusion extending from at least one surface of the cooling passage.

4. The airfoil of claim 3, wherein the swirl structure is generally a spiral ramp.

5. The airfoil of claim 1, wherein the swirl structure comprises a partition extending from at least one surface of the cooling passage, and wherein the partition divides the cooling passage into a plurality of volumes through which the cooling medium can flow.

6. The airfoil of claim 5, wherein the swirl structure is generally a helicoid.

7. The airfoil of claim 1, wherein the swirl structure has between a quarter twist and four twists about an axis extending between an inlet and an outlet of the cooling passage.

8. The airfoil of claim 1, wherein the swirl structure has a straight portion and a twisting portion, and wherein the straight portion is located upstream of the twisting portion.

9. The airfoil of claim 1, wherein the cooling passage is configured to direct cooling medium on to an interior surface of a leading edge of the airfoil.

10. The airfoil of claim 1, wherein the swirl structure imparts tangential velocity to the cooling medium that is 10% to 80% of an absolute velocity of the cooling medium flowing through the cooling passage.

11. An airfoil, comprising:

a concave pressure wall;

a convex suction wall;

a cooling channel extending between the concave pressure wall and the convex suction wall;

a cavity, wherein at least a portion of the cavity is bounded by at least one of the concave pressure wall and the convex suction wall;

an airfoil structure forming at least a portion of a boundary between the cooling channel and the cavity and defining a first cooling passage and a second cooling passage, wherein each of the first cooling passage and the second cooling passage extends through the airfoil structure and is configured to direct a cooling medium from the cooling channel onto a surface of the cavity;

a first swirl structure operatively associated with the first cooling passage and configured to impart tangential velocity to the cooling medium, wherein the first swirl structure is at least partially within the first cooling passage;

a second swirl structure operatively associated with the second cooling passage and configured to impart tangential velocity to the cooling medium, wherein the second swirl structure is at least partially within the second cooling passage, and wherein the first and second cooling passages each have a hydraulic diameter and a centerline axis, and wherein a span between the first and second cooling passages is measured between the centerline axes of each cooling passage, and wherein a ratio of the span between cooling passages divided by the hydraulic diameter of the cooling passages is between 1.5 and 8.

12. A method of manufacturing an airfoil, the method comprising:

forming a cooling channel between a concave pressure wall and a convex suction wall;

forming a cavity, wherein at least a portion of the cavity is bounded by at least one of the concave pressure wall and the convex suction wall;

forming an airfoil structure that forms at least a portion of a boundary between the cooling channel and the cavity;

forming a cooling passage that extends through the airfoil structure and is configured to direct a cooling medium from the cooling channel onto a surface of the cavity; and forming a swirl structure operatively associated with the cooling passage and configured to impart tangential velocity to the cooling medium, wherein the swirl structure is formed at least partially within the cooling passage.

13. The method of claim 12, wherein the swirl structure is formed completely within the cooling passage.

14. The method of claim 12, wherein the swirl structure forms a protrusion extending from at least one surface of the cooling passage.

15. The method of claim 12, wherein the swirl structure forms a partition extending from at least one surface of the cooling passage, and wherein the partition divides the cooling passage into a plurality of volumes through which cooling medium flows.

16. The method of claim 12, wherein the swirl structure has between a quarter twist and four twists about an axis extending between an inlet and an outlet of the cooling passage.

17. The method of claim 12, wherein the swirl structure is configured to impart to the cooling medium a tangential velocity that is 10% to 80% of an absolute velocity of the cooling medium flowing through the cooling passage.

18. The method of claim 12, the method further comprising:

creating a three-dimensional computer model of a casting core for an airfoil, the casting core comprising:

an airfoil structure body configured to form the airfoil structure and the cooling passage; and a swirl structure body configured to form the swirl structure that is operatively associated with the cooling passage and configured to impart tangential velocity to the cooling medium flowing therethrough;

forming a casting core, wherein the casting core is formed in progressive layers by selectively curing a ceramic-loaded resin with ultraviolet light; and processing the casting core thermally, wherein the casting core is suitable for casting.

* * * * *